US006558133B2

(12) United States Patent
Fukanuma et al.

(10) Patent No.: US 6,558,133 B2
(45) Date of Patent: May 6, 2003

(54) VARIABLE DISPLACEMENT COMPRESSOR

(75) Inventors: Tetsuhiko Fukanuma, Kariya (JP); Masahiro Kawaguchi, Kariya (JP); Hiroaki Kayukawa, Kariya (JP); Hiroshi Uneyama, Kariya (JP); Minoru Mera, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 09/988,265

(22) Filed: Nov. 19, 2001

(65) Prior Publication Data

US 2002/0172602 A1 Nov. 21, 2002

(30) Foreign Application Priority Data

Nov. 17, 2000 (JP) ..... 2000-351182
Mar. 9, 2001 (JP) ..... 2001-066857

(51) Int. Cl.[7] ..... F04B 1/26; F04B 1/12; F01B 3/00

(52) U.S. Cl. ..... 417/222.2; 417/269; 92/71

(58) Field of Search ..... 417/222.2, 269, 417/313; 92/71; 184/6.17

(56) References Cited

U.S. PATENT DOCUMENTS 5,782,316 A * 7/1998 Kobayashi et al. ..... 184/6.17
6,015,269 A * 1/2000 Ota et al. ..... 417/222.2
6,123,513 A * 9/2000 Hiramatsu et al. ..... 417/222.2
6,149,398 A * 11/2000 Fukanuma et al. ..... 417/222.2
6,179,578 B1 * 1/2001 Kayukawa et al. ..... 417/313
6,206,648 B1 * 3/2001 Kimura et al. ..... 417/222.2
6,217,293 B1 * 4/2001 Murase et al. ..... 417/222.2

FOREIGN PATENT DOCUMENTS

JP 10-281060 10/1998 ..... F04B/27/14

* cited by examiner

*Primary Examiner*—Charles G. Freay
*Assistant Examiner*—Michael K. Gray
(74) *Attorney, Agent, or Firm*—Morgan & Finnegan, LLP

(57) ABSTRACT

A variable displacement compressor includes a supply passage for supplying refrigerant gas from a discharge chamber to a crank chamber and a bleed passage for bleeding the refrigerant gas from the crank chamber to a suction chamber. An oil separator is connected to a drive shaft and is located in the bleed passage. The oil separator rotates together with the drive shaft to centrifugally separate lubricant oil from the refrigerant gas that flows in the bleed passage. An oil chamber is formed in a compressor housing for receiving the separated oil. The pressure in the oil chamber is equal to or greater than the pressure in the crank chamber. The lubricant oil rapidly returns to the crank chamber through a return passage.

20 Claims, 6 Drawing Sheets

VARIABLE DISPLACEMENT COMPRESSOR

BACKGROUND OF THE INVENTION

The present invention relates to variable displacement compressors that are used in, for example, vehicle air conditioners and adjust the pressure in a crank chamber to vary displacement.

This type of compressor adds lubricant oil mist to refrigerant gas to lubricate the interior of the compressor. The lubricant oil may be isolated from the refrigerant gas that is discharged from the compressor to an external refrigerant circuit, as disclosed in Japanese Unexamined Patent Publication No. 10-281060. The oil is then recirculated to the interior of the compressor, thus further lubricating the interior of the compressor.

This structure includes an oil separator that is located between a discharge chamber and the external refrigerant circuit. An oil return passage connects a crank chamber to the oil separator. After the oil separator separates lubricant oil from refrigerant gas, the lubricant oil returns to the crank chamber through the oil return passage. The oil return passage functions also as a supply passage through which the pressure in the discharge chamber is introduced to the crank chamber, thus controlling the compressor displacement. The supply passage includes a control valve that changes its opening size to adjust the pressure in the crank chamber. A bleed passage connects the crank chamber to a suction chamber. The pressure in the crank chamber is introduced to the suction chamber through the bleed passage to control the displacement.

However, after having been discharged from the crank chamber, lubricant oil must flow in the bleed passage, the suction chamber, compression chambers, and the discharge chamber before reaching the oil separator. This prolongs the time required for recirculation of the lubricant oil to the crank chamber. Accordingly, a relatively small amount of lubricant oil is retained in the crank chamber.

Further, since the entire supply passage functions as the oil return passage, lubricant oil passes through the control valve when flowing from the oil separator to the crank chamber. Thus, the opening size of the control valve may affect the amount of the oil that flows from the oil separator to the crank chamber. That is, for example, if the control valve fully closes the supply passage, the oil flow from the oil separator to the crank chamber stops.

BRIEF SUMMARY OF THE INVENTION

Accordingly, it is an objective of the present invention to provide a variable displacement compressor that rapidly recovers lubricant oil from a control chamber to return the oil to the control chamber.

To achieve the foregoing and other objectives and in accordance with the purpose of the present invention, the present invention is a variable displacement compressor for compressing refrigerant gas that contains lubricant. The compressor compresses the refrigerant gas supplied from a suction chamber to a compression chamber and sends the compressed refrigerant gas to a discharge chamber when a drive shaft rotates. The displacement of the compressor varies in accordance with the pressure in a control chamber located in a compressor housing. The compressor has a supply passage for supplying the refrigerant gas from the discharge chamber to the control chamber and a bleed passage for bleeding the refrigerant gas from the control chamber to the suction chamber. The compressor includes a separator, a lubricant chamber, and a return passage. The separator is located in the bleed passage and rotates together with the drive shaft, thus centrifugally separating the lubricant from the refrigerant gas that flows in the bleed passage. The lubricant chamber is formed in the housing and receives the separated lubricant. The pressure in the lubricant chamber is equal to or greater than the pressure in the control chamber. The return passage is formed in the housing and returns the lubricant from the lubricant chamber to the control chamber.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 9(*b*) is a cross-sectional view showing the end of the drive shaft of FIG. 9, taken in a direction perpendicular to the axis of the drive shaft;

DETAILED DESCRIPTION OF THE PREFERRED EMBODIMENT

An embodiment of a piston type variable displacement compressor for vehicle air conditioners according to the present invention (hereafter referred to simply as a "compressor") will now be described with reference to FIGS. 1 to 3.

Figure 1:
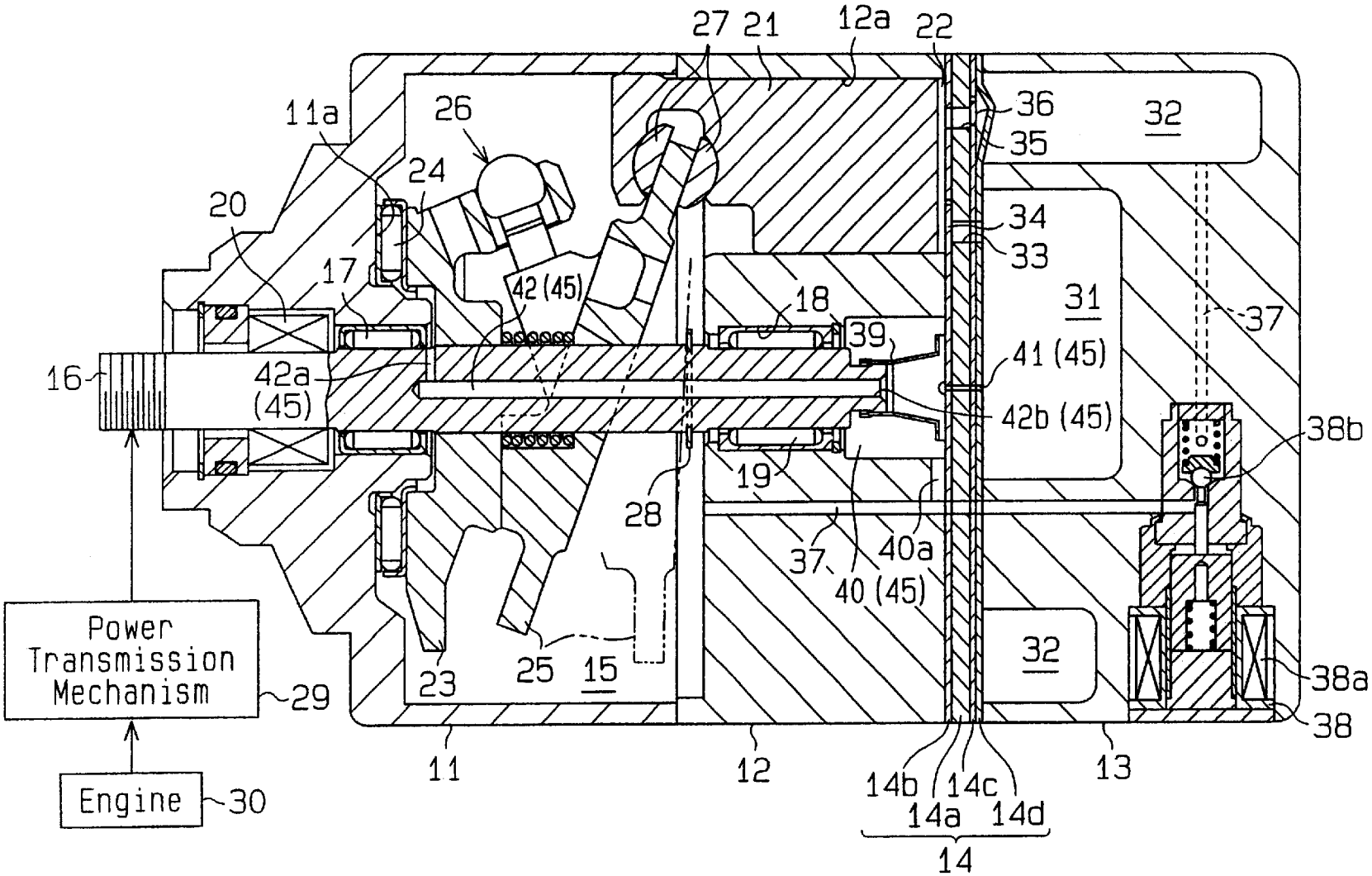
FIG. 1 is a cross-sectional view showing a variable displacement compressor according to the present invention.

As shown in FIG. 1, a front housing member 11 is coupled with a front end of a cylinder block 12. A rear housing member 13 is connected to a rear end of the cylinder block 12 through a valve plate assembly 14. The front housing member 11, the cylinder block 12, and the rear housing member 13 are securely fastened together with a bolt (not shown), thus forming a compressor housing. In the drawing, the left corresponds to the front of the compressor, and the right corresponds to the rear of the compressor.

The valve plate assembly 14 includes a main plate 14*a*, a suction valve plate 14*b*, a discharge valve plate 14*c*, and a retainer plate 14*d*. The suction valve plate 14*b* is formed of hardened carbon band steel. The suction valve plate 14*b* is attached to the front side of the main plate 14*a*, and the discharge valve plate 14*c* is attached to the rear side of the main plate 14*a*. The retainer plate 14*d* is attached to the rear side of the discharge valve plate 14*c*. The valve plate assembly 14 is connected to the cylinder block 12 at the front side of the suction valve plate 14*b*.

The front housing member 11 and the cylinder block 12 form a crank chamber 15, or a control chamber. A drive shaft 16 extends through the crank chamber 15 such that the front end of the drive shaft 16 projects from the front housing member 11. The front housing member 11 and the cylinder block 12 rotationally support the drive shaft 16. The front housing member 11 supports a front portion of the drive shaft 16 through a radial bearing 17. An accommodating recess 18 is formed in the substantial middle of the cylinder block 12. A radial bearing 19 is located in the accommodating recess 18. The accommodating recess 18 supports a rear portion of the drive shaft 16 through the radial bearing 19. A shaft seal 20 is located around the front portion of the drive shaft 16.

A power transmitting mechanism 29 operationally connects the front end of the drive shaft 16 to a vehicle engine 30, or an external drive source of the compressor. The power transmitting mechanism 29 may be a clutch type that selectively permits and blocks power transmission in accordance with an external control procedure (for example, an electromagnetic clutch). Alternatively, the power transmitting mechanism 29 may be a clutchless type that constantly transmits power (for example, a pulley combined with a belt). In this embodiment, the power transmitting mechanism 29 is the clutchless type.

A plurality of cylinder bores 12*a* (only one is shown) are formed in the cylinder block 12 and are located around the drive shaft 16 at equal angular intervals. Each cylinder bore 12*a* movably accommodates a single-headed piston 21. Each piston 21 closes the front opening of the associated cylinder bore 12*a*, and the valve plate assembly 14 closes the rear end of each cylinder bore 12*a*. Each piston 21 forms a compression chamber 22 in the associated cylinder bore 12*a* and moves in the cylinder bore 12*a* to change the volume of the compression chamber 22.

A lug plate 23, or a rotational support, is securely fitted around the drive shaft 16 in the crank chamber 15 to rotate integrally with the drive shaft 16. The lug plate 23 abuts against an inner wall 11*a* of the front housing member 11 through a thrust bearing 24. The inner wall lla receives the load that acts on the drive shaft 16 due to the reactive force to the operation of each piston 21. The inner wall 11*a* thus functions as a forward movement restrict or that restricts forward axial movement of the drive shaft 16, or sliding of the drive shaft 16 away from the valve plate assembly 14.

A suction chamber 31 is formed in the middle of the rear housing member 13. A discharge chamber 32 is formed around the suction chamber 31 in the rear housing member 13. The valve plate assembly 14 includes a suction port 33 corresponding to each compression chamber 22, a suction valve flap 34 that selectively opens and closes the suction port 33, a discharge port 35 corresponding to each compression chamber 22, and a discharge valve flap 36 that selectively opens and closes the discharge port 35. Each suction port 33 connects the suction chamber 31 to the associated compression chamber 22. Each discharge port 35 connects the associated compression chamber 22 to the discharge chamber 32. An external refrigerant circuit (not shown) is located in the exterior of the compressor to connect the suction chamber 31 to the discharge chamber 32.

A swash plate 25, or a drive plate, is located in the crank chamber 15 such that the drive shaft 16 extends through a hole formed in the swash plate 25. A hinge mechanism 26 connects the lug plate 23 to the swash plate 25. As described, the drive shaft 16 supports the lug plate 23. The swash plate 25 thus rotates integrally with the lug plate 23 and the drive shaft 16 and inclines with respect to the drive shaft 16 while sliding axially along the drive shaft 16. The lug plate 23, the swash plate 25, and the hinge mechanism 26 form a displacement varying mechanism.

Each piston 21 is connected to the outer periphery of the swash plate 25 through shoes 27. Thus, when the drive shaft 16 rotates and the swash plate 25 rotates integrally with the lug plate 23 through the hinge mechanism 26, the shoes 27 convert the rotation of the swash plate 25 to movement of each piston 21. The lug plate 23, the swash plate 25, the hinge mechanism 26, and the shoes 27 form a crank mechanism. The crank mechanism enables the rotation of the drive shaft 16 to compress refrigerant gas in each compression chamber 22.

When each piston 21 moves, refrigerant gas flows from the suction chamber 31 to each compression chamber 22 and is compressed in the compression chamber 22 before being discharged to the discharge chamber 32. This operation is repeated as long as the piston 21 moves. The refrigerant gas flows from the discharge chamber 32 to the external refrigerant circuit through a discharge line.

A bleed passage 45 extends through the front housing member 11, the cylinder block 12, and the rear housing member 13 to connect the crank chamber 15 to the suction chamber 31. A supply passage 37 extends through the cylinder block 12 and the rear housing member 13 to connect the crank chamber 15 to the discharge chamber 32. A control valve 38, or an electromagnetic valve, is formed in the supply passage 37. The control valve 38 operates a valve body 38*b* in accordance with external power supplied to a solenoid 38*a*, thus adjusting the opening size of the supply passage 37. That is, the control valve 38 functions as a restrictor, or, more specifically, a variable restrictor.

More specifically, a control device (not shown) adjusts the opening size of the control valve 38 to control the difference between the amount of the high-pressure refrigerant gas in the supply passage 37 and the amount of the refrigerant gas in the bleed passage 45. This determines the pressure in the crank chamber 15 and thus changes the difference between the pressure in the crank chamber 15 and the pressure in each compression chamber 22, which act on opposite sides of the associated piston 21. Accordingly, the angle at which the swash plate 25 inclines with respect to the drive shaft 16 changes to vary the stroke of each piston 21, or compressor displacement.

If the opening size of the supply passage 37 decreases, for example, the pressure in the crank chamber 15 is lowered. This reduces the difference between the pressure in the crank chamber 15 and the pressure in each compression chamber 22. The swash plate 25 thus inclines to increase its inclination angle. The stroke of each piston 21 thus increases to raise the compressor displacement. In contrast, if the opening size of the supply passage 37 increases, the pressure in the crank chamber 15 is raised. This increases the difference between the pressure in the crank chamber 15 and the pressure in each compression chamber 22. The swash plate 25 thus inclines to decrease its inclination angle. The stroke of each piston 21 thus decreases to lower the compressor displacement.

An annular, minimum inclination restrictor 28 is fitted around the drive shaft 16 and is located between the swash plate 25 and the cylinder block 12. As indicated by the double-dotted broken line in FIG. 1, the swash plate 25 inclines at a minimum angle as abutted by the minimum inclination restrictor 28. Further, as indicated by the solid line in the drawing, the swash plate 25 inclines at a maximum angle as abutted directly by the lug plate 23.

Figure 2:
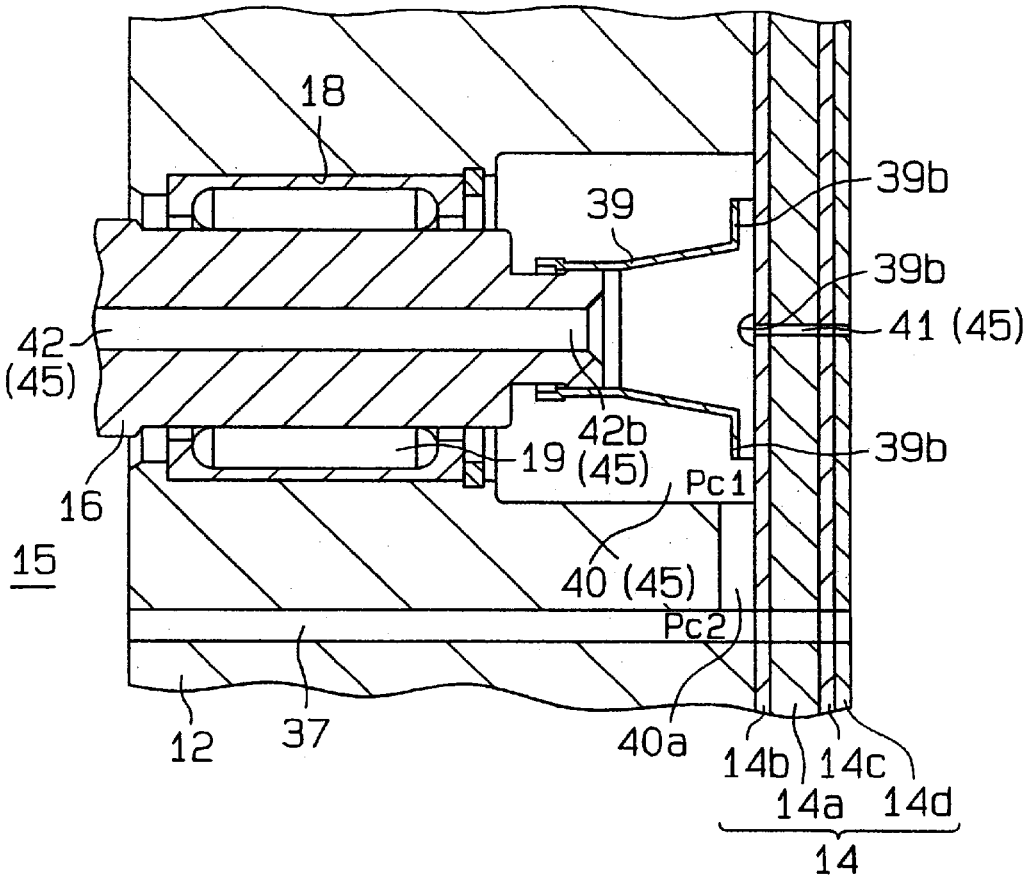
FIG. 2 is an enlarged view showing a main portion of the compressor of FIG. 1.
Figure 3:
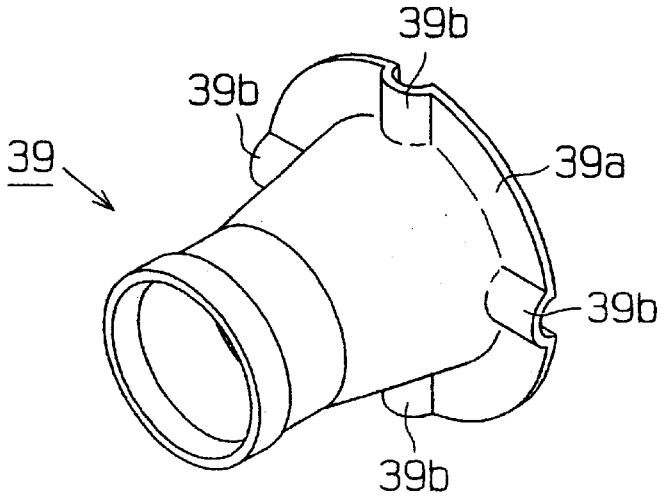
FIG. 3 is a perspective view showing an oil separator of the compressor of FIG. 1.

As shown in FIGS. 1 to 3, a substantial rear half of the accommodating recess 18 functions as a lubricant oil chamber 40 that accommodates an oil separator 39. The radial bearing 19 and the drive shaft 16 close the front end of the oil chamber 40. The valve plate assembly 14 closes the rear end of the oil chamber 40. A passage 41 is formed in the valve plate assembly 41 to connect the oil chamber 40 to the suction chamber 31. The passage 41 is located substantially along the axis of the drive shaft 16. The communication area of the passage 41 is selected to form an optimal restrictor.

The section of the supply passage 37 between the control valve 38 and the crank chamber 15 is located below the oil chamber 40, as viewed in FIG. 1. A communication passage 40*a* connects this section of the supply passage 37 to a rear, lowermost portion of the oil chamber 40 (corresponding to the rear end of the cylinder block 12). The communication area of the supply passage 37 is sufficiently reduced, as compared to that of the accommodating recess 18. The communication passage 40*a* and the section of the supply passage 37 downstream of (toward the crank chamber 15 from) the communication passage 40*a* form an oil return passage.

A communication hole 42 extends through the drive shaft 16 to connect the crank chamber 15 to the oil chamber 40. An inlet 42*a* of the communication hole 42 opens to the crank chamber 15 at a position of the drive shaft 16 rearward from the radial bearing 17. An outlet 42*b* of the communication hole 42 opens to the oil chamber 40 at the rear end of the drive shaft 16.

The drive shaft 16 has a small diameter portion at its rear end. The oil separator 39 is securely press-fitted in the small diameter portion. The proximal end of the oil separator 39 is secured to the drive shaft 16. The oil separator 39 is substantially cylindrical and has an inner side slanted to increase the inner diameter of the oil separator 39 from the proximal end of the oil separator 39 toward the distal (rear) end of the same. The inner diameter of the oil separator 39 is thus largest at the distal end of the oil separator 39.

As shown in FIG. 3, a flange 39*a* is formed at the proximal end of the oil separator 39. The flange 39*a* has a plurality of (in this embodiment, four) grooves 39*b*, each of which functions as a communication port. Each groove 39*b* connects the interior of the oil separator 39 to the exterior when the distal end of the oil separator 39 abuts against the value plate assembly 14. The grooves 39*b* open toward the valve plate assembly 14.

The oil separator 39 is formed of, for example, a plate of SPC (cold rolled steel) or SUC 304 (stainless steel) through pressing. The plate thickness is one millimeter or smaller.

When the oil separator 39 is assembled with the drive shaft 16, the flange 39*a* is located near to the communication passage 40*a*. The communication hole 42, the interior of the oil separator 39, the accommodating recess 18 (the oil chamber 40), and the passage 41 form the bleed passage 45.

When the flange 39*a* of the oil separator 39 abuts against the suction valve plate 14*b*, the drive shaft 16 is stopped from sliding further toward the valve plate assembly 14. That is, the front side of the suction valve plate 14*b* functions as a rearward movement restrictor that restricts rearward axial movement of the drive shaft 16, or sliding of the drive shaft 16 toward the valve plate assembly 14.

If the drive shaft 16 slides toward the valve plate assembly 14 and the flange 39*a* of the oil separator 39 abuts against the valve plate assembly 14, the valve plate assembly 14 closes the distal end of the oil separator 39. However, in this state, the grooves 39*b* connect the interior of the oil separator 39 to the exterior. In other words, each groove 39*b* functions as an oil discharge port through which oil is discharged from the oil separator 39 to the exterior.

When the lug plate 23 abuts against the inner side 11*a* through the thrust bearing 24 to stop the drive shaft 16 from sliding further forward, space is formed between the valve plate assembly 14 and the oil separator 39. The space is smaller than a minimum space between each piston 21 and the valve plate assembly 14 when the piston 21 is located at its top dead center.

When flowing from the crank chamber 15 to the suction chamber 31 through the bleed passage 45, refrigerant gas passes through the oil separator 39. The oil separator 39 has a cylindrical shape and includes an internal passage that forms part of the bleed passage 45. In the internal passage of the oil separator 39, the refrigerant gas in the vicinity of the inner side of the oil separator 39 rotates together with the oil separator 39. This generates centrifugal force to separate lubricant oil mist from the refrigerant gas.

The separated lubricant oil adheres to the inner side of the oil separator 39. However, the centrifugal force generated by the rotation of the oil separator 39 and the flow of the refrigerant gas in the oil separator 39 act to urge the adhered lubricant oil along the inner side of the oil separator 39 toward the distal end of the oil separator 39. The lubricant oil is thus discharged from the oil separator 39 through the space between the distal end of the oil separator 39 and the valve plate assembly 14 and through the grooves 39*b*. The lubricant oil is then collected in the oil chamber 40 (the space around the oil separator 39). The pressure in the vicinity of the inner side of the oil separator 39 (particularly, near the distal end of the oil separator 39) increases due to the rotation of the refrigerant gas.

As described, when passing through the oil separator 39, some refrigerant gas rotates together with the oil separator 39. The rotation of the refrigerant gas, particularly in the vicinity of the flange 39*a*, increases the pressure in the space around the oil separator 39 in the oil chamber 40, or, particularly, the pressure Pc1 in the vicinity of the communication passage 40*a* (see FIG. 2). These pressures are thus slightly higher than the pressure in the crank chamber 15. In other words, the oil separator 39 functions as a rotary member.

The control valve 38 restricts the refrigerant gas flow in the section of the supply passage 37 near the communication passage 40*a*. Further, the flow speed of the refrigerant gas in the supply passage 37 is faster than that of the refrigerant gas in the crank chamber 15. Thus, the pressure Pc2 (see FIG. 2) in the section of the supply passage 37 near the communication passage 40*a* is lower than the pressure in the crank chamber 15.

The difference between the pressure Pc1 and the pressure Pc2 prevents lubricant oil from flowing from the supply passage 37 to the oil chamber 40 through the communication passage 40*a*. Further, this pressure difference efficiently sends the lubricant oil from the oil chamber 40 to the supply passage 37 through the communication passage 40*a*. Once the lubricant oil reaches the supply passage 37, the oil returns to the crank chamber 15 together with the refrigerant gas. Thus, a sufficient amount of lubricant oil is retained in the crank chamber 15, thus optimally lubricating the components in the crank chamber 15. Further, a decreased amount of lubricant oil is discharged from the compressor to the external refrigerant circuit. This prevents operation of a heat exchanger from being otherwise hampered by adhesion of the lubricant oil to the inner side of the heat exchanger. The air conditioner thus has an improved cooling efficiency.

After the oil separator 39 separates lubricant oil from refrigerant gas, some refrigerant gas flows from the oil separator 39 to the suction chamber 31 through the passage 41. The refrigerant gas is then discharged from the suction chamber 31 to the external refrigerant circuit through the compression chambers 22 and the discharge chamber 32.

The inner side 11*a* of the front housing member 11 receives the load that acts on each piston 21 due to the compression of the refrigerant gas through the shoes 27, the swash plate 25, the hinge mechanism 26, the lug plate 23, and the thrust bearing 24. In other words, through the lug plate 23 and the thrust bearing 24, the inner side lha of the front housing member 11 supports a connected body that includes the drive shaft 16, the swash plate 25, the lug plate 23, and the pistons 21. This restricts forward movement of the connected body in an axial direction of the drive shaft 16.

If depression of an accelerator pedal (not shown) of the vehicle exceeds a predetermined level, for example, such that the control device of the control valve 38 determines that the vehicle is being accelerated, the control device may minimize the compressor displacement. If this procedure, or the displacement minimizing procedure, is started when the displacement is at a maximum level, the control valve 38 must quickly switch the supply passage 37 from a fully closed state to a fully open state. Thus, high-pressure refrigerant gas rapidly flows from the discharge chamber 32 to the crank chamber 15. In this state, the bleed passage 45 cannot bleed a sufficient amount of refrigerant gas from the crank chamber 15 to the suction chamber 31. The pressure in the crank chamber 15 thus increases rapidly.

In this case, the pressure in the crank chamber 15 may be excessively high, and the swash plate 25 may incline excessively fast to decrease its inclination angle. Thus, when the swash plate 25 reaches its minimum inclination angle (as indicated by the double-dotted broken line in FIG. 1), the swash plate 25 is pressed against the minimum inclination restrictor 28 by excessive force. Further, the lug plate 23 is urged rearward through the hinge mechanism 26 by excessive force. The drive shaft 16 thus moves toward the valve plate assembly 14. However, the abutment between the flange 39*a* of the oil separator 39 and the valve plate assembly 14 stops the drive shaft 16 from moving further rearward.

As described, the space between the valve plate assembly 14 and the oil separator 39 when the forward movement of the drive shaft 16 is restricted is smaller than the space between each piston 21 and the valve plate assembly 14 when the piston 21 is located at its top dead center. Thus, when the rearward movement of the drive shaft 16 is restricted, the pistons 21 operate without hitting the valve plate assembly 14. The pistons 21 and the valve plate assembly 14 thus remain undamaged.

The illustrated embodiment has the following advantages.

(1) The oil separator 39 is located in the bleed passage 45 to separate lubricant oil from the refrigerant gas that flows from the crank chamber 15 to the suction chamber 31. Thus, as compared to the prior art, lubricant oil recirculates to the crank chamber 15 in a relatively short time. This maintains a sufficient amount of lubricant oil in the crank chamber 15. Further, the oil separator 39 is located relatively close to the crank chamber 15, as compared to the prior art. This shortens the path of the lubricant oil that flows from the oil separator 39 to the crank chamber 15.

(2) As described, the supply passage 37 includes the control valve 38, or the restrictor. The pressure in the section of the supply passage 37 between the crank chamber 15 and the control valve 38 is thus maintained at a level equal to or lower than the pressure in the crank chamber 15. Further, the communication passage 40*a* connects the oil chamber 40 to the section of the supply passage 37 between the crank chamber 15 and the control valve 38. The pressure in the oil chamber 40 is maintained at a level equal to or higher than the pressure in the crank chamber 15. Lubricant oil thus efficiently flows from the oil chamber 40 to the supply passage 37 through the communication passage 40*a*. In addition, since a portion of the supply passage 37 functions as an oil return passage, the structure of the compressor becomes relatively simple, as compared to a compressor that has a separate oil return passage.

Further, since the control valve 38 functions as the restrictor of the supply passage 37, a separate restrictor need not be formed in the supply passage 37. This simplifies the structure of the compressor. Further, as described, a section of the supply passage 37 downstream of the control valve 38 forms part of the oil return passage. Thus, the opening size of the control valve 38 does not greatly affect the amount of the lubricant oil that returns from the oil chamber 40 to the crank chamber 15. In other words, if, for example, the control valve 38 fully closes the supply passage 37, the oil return passage from the oil chamber 40 to the crank chamber 15 is maintained in an open state. Lubricant oil thus returns from the oil chamber 40 to the crank chamber 15.

(3) The oil chamber 40 receives the rotary member, or the oil separator 39. When the oil separator 39 rotates together with the drive shaft 16, the pressure in the oil chamber 40 increases. This prevents lubricant oil from returning from the communication passage 40*a* to the oil chamber 40. The lubricant oil thus easily flows from the oil chamber 40 to the crank chamber 15 through the oil return passage. Further, since the oil separator 39 functions as the rotary member, the structure of the compressor becomes relatively simple, as compared to the case in which a rotary member is formed separately from the oil separator 39. In addition, since the oil chamber 40 accommodates the oil separator 39, the compressor has a relatively simple structure, unlike a compressor in which an independent chamber accommodates the oil separator 39 and a separate passage connects this chamber to the oil chamber 40.

(4) As described, the oil separator 39 separates lubricant oil from refrigerant gas by centrifugal force. Since the interior of the oil separator 39 forms part of the bleed passage 45, the refrigerant gas smoothly rotates together with the oil separator 39. The lubricant oil is thus separated from the refrigerant gas with a high efficiency.

(5) A portion (the communication hole 42) of the bleed passage 45 is formed in the drive shaft 16. Refrigerant gas thus flows from the crank chamber 15 to the oil separator 39 through the communication hole 42 of the drive shaft 16. Accordingly, it is thus easy to form a structure for introducing refrigerant gas from the crank chamber 15 to the oil separator 39.

(6) The inner side of the oil separator 39 is slanted to increase its diameter from the proximal, upstream end to the distal, downstream end of the oil separator 39. The lubricant oil adhered to the inner side of the oil separator 39 thus smoothly moves toward the distal end of the oil separator 39, due to the centrifugal force caused by the rotation of the oil separator 39. Accordingly, the lubricant oil is smoothly discharged from the oil separator 39 through the distal opening and the grooves 39*b* of the oil separator 39.

(7) The structure for restricting the rearward movement of the drive shaft 16 does not necessarily have to be the one described in the illustrated embodiment. As a comparative example, an urging spring may restrict the rearward movement of the drive shaft 16. More specifically, the urging spring urges the drive shaft 16 forward with respect to the front housing member 11, the cylinder block 12, and the rear housing member 13, thus restricting the rearward movement of the drive shaft 16. However, in the comparative example, the durability of the thrust bearing 24 that receives the force of the urging spring may be hampered, and an increased power loss of the compressor may be caused by the thrust bearing 24. Further, the structure associated with the urging spring becomes complicated. In contrast, in the illustrated embodiment, the abutment between the oil separator 39 and the valve plate assembly 14 restricts the rearward movement of the drive shaft 16. This structure solves the problems otherwise caused by the urging spring.

(8) The grooves 39*b* are formed at the distal end of the oil separator 39. When the oil separator 39 abuts against the valve plate assembly 14, the grooves 39*b* connect the interior of the oil separator 39 to the exterior. Thus, even if the valve plate assembly 14 closes the distal end of the oil separator 39, lubricant oil is discharged from the oil separator 39 to the exterior through the grooves 39*b*.

(9) The space that accommodates the rear portion of the drive shaft 16 (the accommodating recess 18) also accommodates the oil separator 39. This minimizes the compressor regardless of the oil separator 39.

(10) The oil separator 39 is formed through pressing. This reduces the cost, as compared to the case in which the oil separator 39 is formed through cutting.

(11) The oil separator 39 is accommodated in the oil chamber 40 such that the flange 39*a* of the oil separator 39 is located close to the communication passage 40*a*. Thus, when the oil separator 39 rotates, the pressure Pc1 in the vicinity of the communication passage 40*a* in the oil chamber 40 readily increases. This efficiently introduces lubricant oil from the oil chamber 40 to the supply passage 37 through the communication passage 40*a* and prevents the lubricant oil from returning from the supply passage 37 to the oil chamber 40.

(12) A section of the supply passage 37 is located below the oil chamber 40, as viewed in FIG. 1. This section is connected to the lowermost portion of the oil chamber 40 through the communication passage 40*a*. Thus, as compared to the case in which the opening of the communication passage 40*a* to the oil chamber 40 is located higher than the lowermost portion of the oil chamber 40, lubricant oil easily flows from the oil chamber 40 to the supply passage 37 due to gravity.

(13) The crank chamber 15 accommodates the crank mechanism that enables the rotation of the drive shaft 16 to compress refrigerant gas in the compression chambers 22. Also, the crank chamber 15 functions as the control chamber the pressure of which is adjusted to control the displacement varying mechanism. The crank mechanism is thus sufficiently lubricated.

(14) The control valve 38 is located in the supply passage 37 to control the pressure in the crank chamber 15, or the compressor displacement. This type of controlling is referred to as "supply controlling" and is based on the opening size of the supply passage 37 in which the pressure of the refrigerant gas is relatively high. Thus, the supply controlling has a relatively quick response in varying the pressure in the crank chamber 15, or the compressor displacement, as compared to "bleed controlling" based on the opening size of the bleed passage 45.

(15) The oil separator 39 abuts against the valve plate assembly 14 through the flange 39*a*. This increases the contact area of the oil separator 39 with respect to the valve plate assembly 14. Abrasive wear of the valve plate assembly 14 and the oil separator 39 are thus suppressed.

(16) The valve plate assembly 14 (the suction valve plate 14*b*) functions as the rearward movement restrictor for the drive shaft 16. This simplifies the structure for restricting the movement of the drive shaft 16.

(17) The abutment between the oil separator 39 and the suction valve plate 14*b* restricts the rearward movement of the drive shaft 16. The material of the suction valve plate 14*b* has an increased anti-abrasion performance, as compared to that of the main plate 14*a*. That is, as compared to the case in which the oil separator 39 abuts against the main plate 14*a* as a rearward movement restrictor, the rearward movement restrictor of the illustrated embodiment has an improved anti-abrasion performance.

(18) The power transmitting mechanism 29 is a clutchless type and constantly drives the compressor as long as the engine is operating. Thus, as compared to the compressor driven by a clutch type power transmitting mechanism, the components of the crank chamber 15 of the illustrated embodiment need be lubricated sufficiently. The present invention is thus particularly effective for the compressor with the clutchless type power transmitting mechanism 29.

The present invention may be modified as follows without departing from the scope and spirit of the invention.

The diameter of the inner side of the oil separator 39, to which lubricant oil adheres, does not necessarily have to be increased from the proximal end toward the distal end of the oil separator 39. For example, as shown in FIGS. 4 and 5, an oil separator 50 may have an inner side the diameter of which is uniform from the proximal end to the distal end of the oil separator 50.

Figure 4:
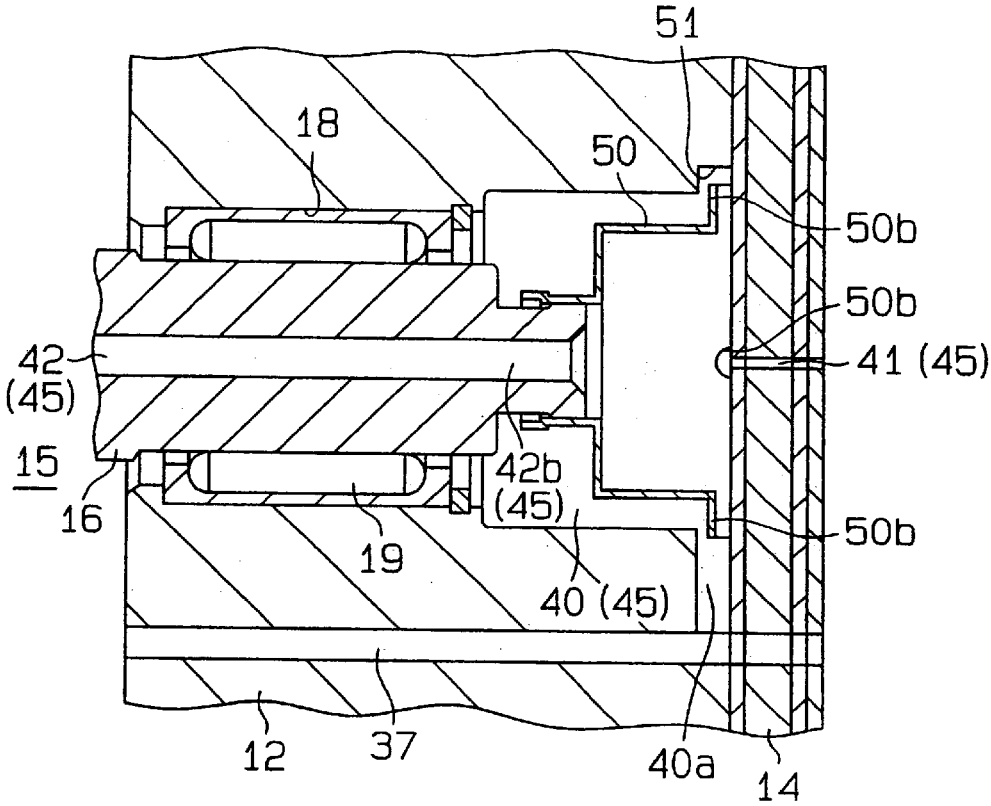
FIG. 4 is an enlarged cross-sectional view showing a main portion of a compressor of a modification.
Figure 5:
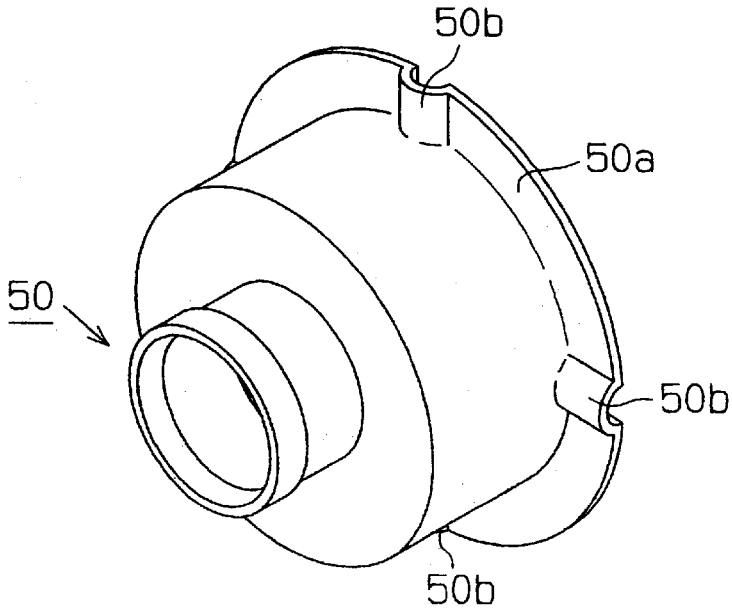
FIG. 5 is a perspective view showing an oil separator of the compressor of FIG. 4.

As shown in FIGS. 4 and 5, the oil separator 50 has a flange 50*a* at its distal end and a plurality of grooves 50*b* formed in the flange 50*a*, like the oil separator 39 of the illustrated embodiment. The grooves 50*b* connect the interior of the oil separator 50 to the exterior. Further, the oil chamber 40 has an annular space 51 at the rear end of the oil chamber 40. The annular space 51 is located radially outward from the remaining space of the oil chamber 40. The annular space 51 receives the flange 50*a* and a portion of each groove 50*b*. The communication passage 40*a* connects the annular space 51 to the supply passage 37. The diameter of the inner side of the oil separator 50 is larger than the maximum diameter of the inner side of the oil separator 39. The outer diameter of the flange 50*a* is larger than that of the flange 39*a*.

Thus, the outer periphery of the flange 50*a* is located closer to the supply passage 37 than that of the flange 39*a*. Accordingly, after lubricant oil is discharged from the oil separator 50, the lubricant oil efficiently flows from the space around the oil separator 50 (the annular space 51 of the oil chamber 40) to the supply passage 37. Further, since the diameter of the inner side of the oil separator 50 is larger than that of the oil separator 39, the circumferential speed of the oil separator 50 becomes relatively high when the oil separator 50 rotates. This further efficiently separates lubricant oil from refrigerant gas in the oil separator 50 and further increases the pressure in the vicinity of the inner side of the oil separator 50 and the pressure in the oil chamber 40 (the space around the oil separator 50).

Figure 6:
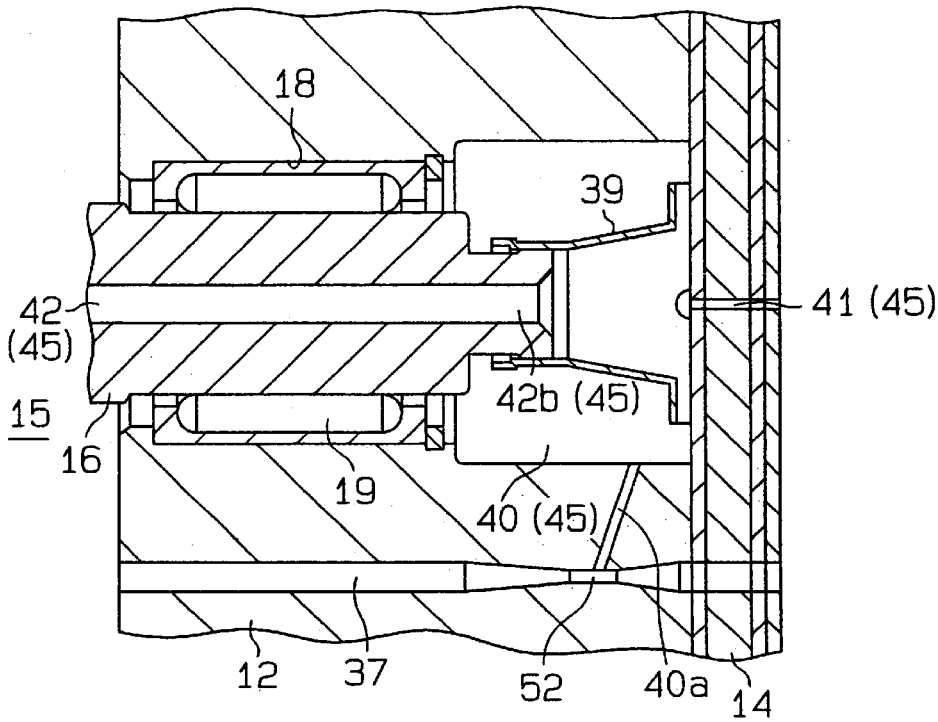
FIG. 6 is an enlarged cross-sectional view showing a main portion of a compressor of another modification.

As shown in FIG. 6, a fixed restrictor 52, or an additional restrictor, may be located in the portion of the supply passage 37 between the control valve 38 and the crank chamber 15. The communication passage 40*a* connects the fixed restrictor 52 to the oil chamber 40. The fixed restrictor 52 thus functions as a throat of a so-called venturi tube. That is, the flow rate of the refrigerant gas at the fixed restrictor 52 becomes relatively high, thus decreasing the pressure of the refrigerant gas at the fixed restrictor 52. This efficiently introduces lubricant oil from the oil chamber 40 to the supply passage 37.

Figure 7:
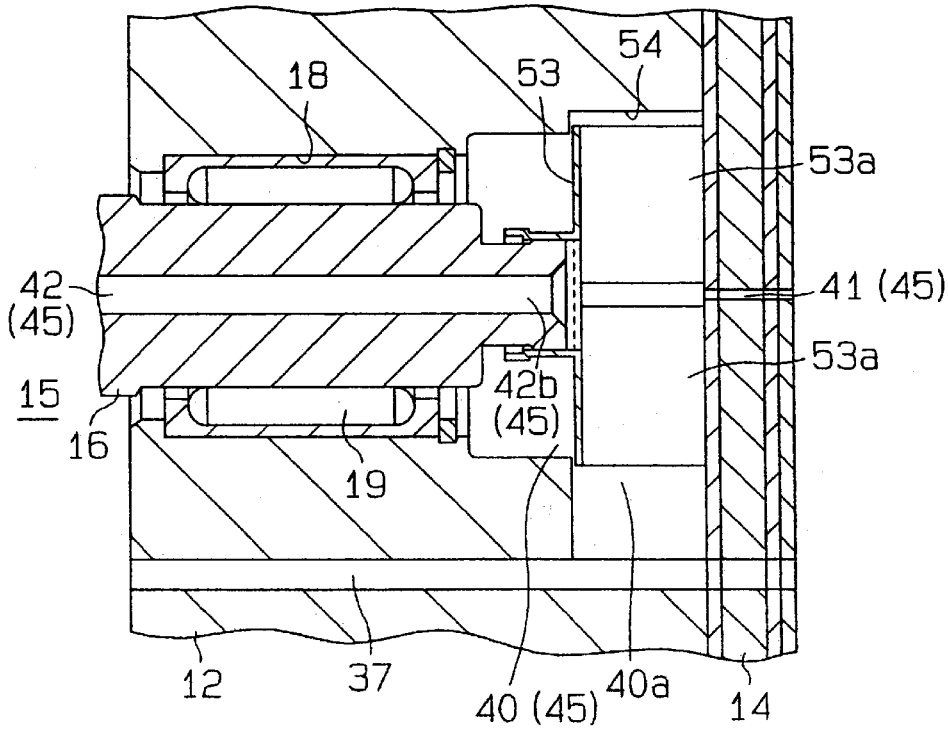
FIG. 7 is an enlarged cross-sectional view showing a main portion of a compressor of another modification.

An oil separator according to the present invention does not necessarily have to be cylindrical but may be shaped as indicated in FIG. 7. More specifically, a rotor 53 is fitted around the rear end of the drive shaft 16. The oil chamber 40 includes an annular space 54 at its rear portion. The annular space 54 is located radially outward from the remaining space of the oil chamber 40. The annular space 54 accommodates the rotor 53. The rotor 53 includes a plurality of fins 53*a* that are located around the axis of the drive shaft 16 at equal angular intervals. The diameter of the portion of the rotor 53 around which the fins 53*a* are formed is larger than the diameter of a front portion of the oil chamber 40.

Thus, when the rotor 53 rotates together with the drive shaft 16, lubricant oil mist is isolated from refrigerant gas due to a centrifugal pump effect. That is, the rotor 53 functions as an oil separator. Further, the rotation of the rotor 53 increases the pressure in the oil chamber 40. This efficiently introduces lubricant oil from the oil chamber 40 to the supply passage 37 through the communication passage 40*a*.

Figure 8A:
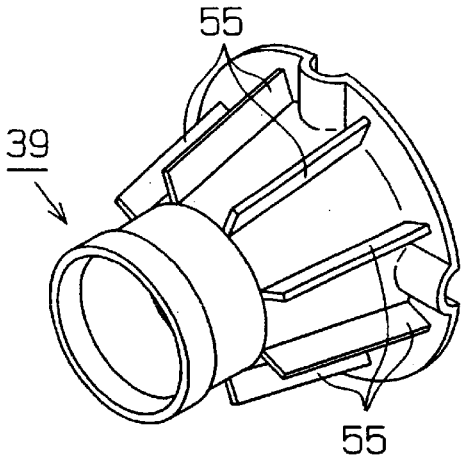
FIG. 8(*a*) and FIG. 8(*b*) are perspective views each showing an oil separator of another modification.
Figure 8B:
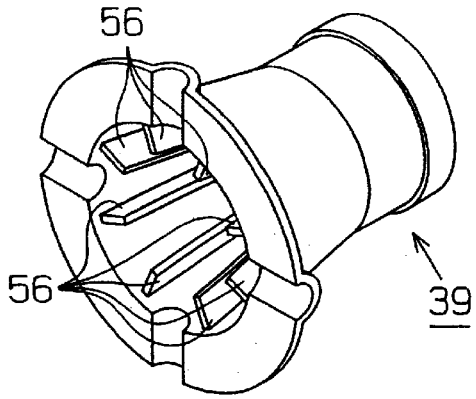

Fins may be formed around the oil separator 39. More specifically, as shown in FIG. 8(*a*), a plurality of fins 55 may be formed around the oil separator 39 as located around the axis of the oil separator 39 at equal angular intervals. When the oil separator 39 rotates, the fins 55 further increase the pressure in the oil chamber 40. Accordingly, lubricant oil further efficiently flows from the oil chamber 40 to the supply passage 37 through the communication passage 40*a*.

Alternatively, fins may be located in the oil separator 39. More specifically, as shown in FIG. 8(*b*), a plurality of fins 56 may project from the inner side of the oil separator 39 as located around the axis of the oil separator 39 at equal angular intervals. In this case, when the oil separator 39 rotates, the fins 56 further efficiently rotate refrigerant gas together with the oil separator 39. This further efficiently isolates lubricant oil mist from refrigerant gas by centrifugal force in the oil separator 39. Further, the rotation of the fins 56 increases the pressure in the oil separator 39, thus further reliably preventing lubricant oil from returning from the exterior of the oil separator 39 to the interior.

Figure 9A:
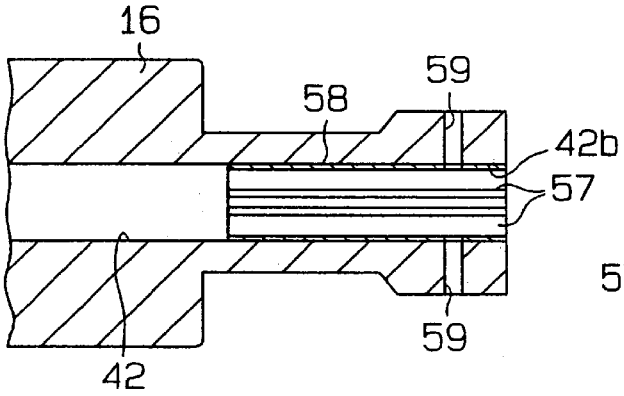
FIG. 9(*a*) is an enlarged cross-sectional view showing an end of a drive shaft of another modification.
Figure 9B:
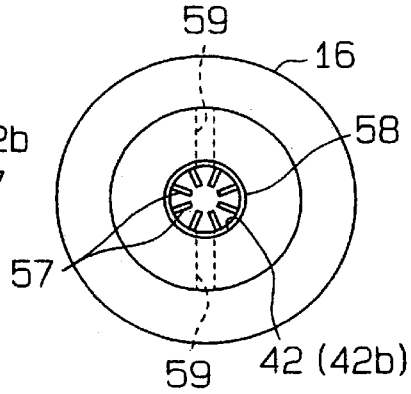

Further, fins may be located in the communication hole 42 of the drive shaft 16. More specifically, as shown in FIG. 9, a cylinder 58 may be securely fitted in a portion of the communication hole 42 near its outlet 42*b*. A plurality of fins 57 project from the inner side of the cylinder 58 as located around the axis of the cylinder 58 at equal angular intervals. Holes extend through the cylinder 58 to connect the interior of the cylinder 58 to the exterior. Through holes 59 are formed in the drive shaft 16. The holes in the cylinder 58 and the through holes 59 thus connect the interior of the cylinder 58 to the space around the drive shaft 16. In this structure, after having been isolated from refrigerant gas by centrifugal force in the cylinder 58, lubricant oil is discharged to the space around the drive shaft 16 through the holes in the cylinder 58 and the through holes 59.

Figure 10:
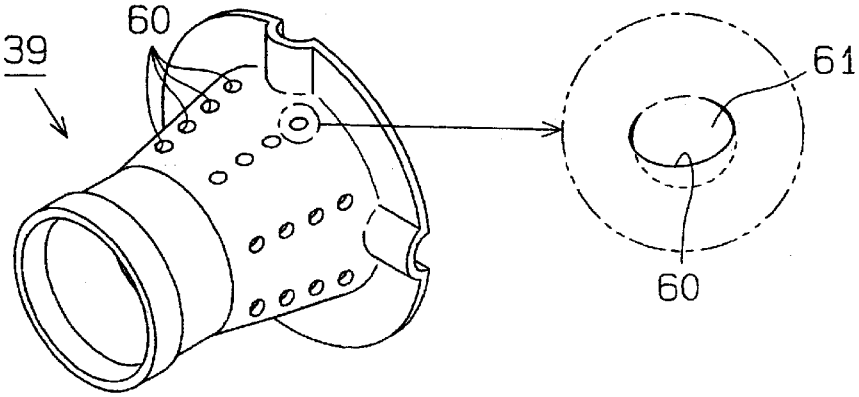
FIG. 10 is a perspective view showing an oil separator of another modification.

As shown in FIG. 10, a plurality of through holes 60 may be formed in the circumferential wall of the oil separator 39, thus connecting the interior of the oil separator 39 to the exterior. More specifically, each through hole 60 is formed as follows. First, a plurality of arched cuts are formed in the circumferential wall of the oil separator 39. Each arched cut forms a disk-like cut piece 61. Each cut piece 61 is then bent toward the interior of the oil separator 39. The through holes 60 are thus formed in the circumferential wall of the oil separator 39. Each cut piece 61 forms a small fin. Since the cut pieces 61 are bent, refrigerant gas hits the surfaces of the cut pieces 61 when the oil separator 39 rotates.

When the oil separator 39 rotates, the through holes 60 and the cut pieces 61 efficiently generate a refrigerant gas flow in the vicinity of the inner side of the oil separator 39. Lubricant oil is thus efficiently isolated from refrigerant gas by centrifugal force. Further, the pressure in the oil separator 39 efficiently increases, and lubricant oil is further reliably prevented from returning from the exterior of the oil separator 39 to the interior.

As described, the oil separator 39 separates lubricant oil from refrigerant gas through the rotation of the drive shaft 16. In addition to the oil separator 39, the compressor may employ a second oil separator 71 that operates independently from the drive shaft 16. More specifically, the is structure of FIGS. 11(*a*) and 11(*b*) may be added to the compressor of the illustrated embodiment.

Figure 11:
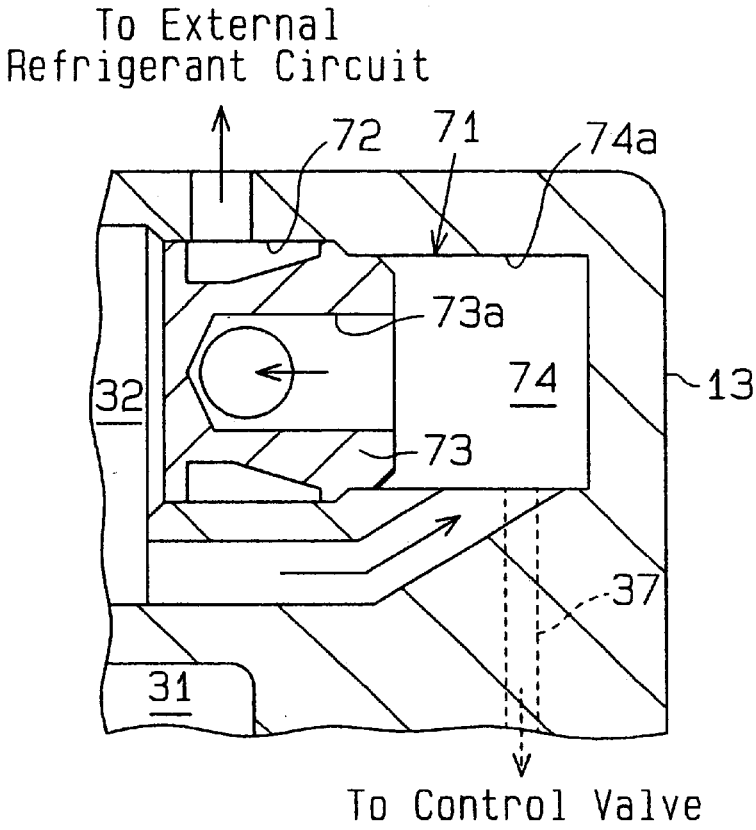
FIG. 11(*a*) and FIG. 11(*b*) are views each showing a second oil separator of another modification.
Figure 11:
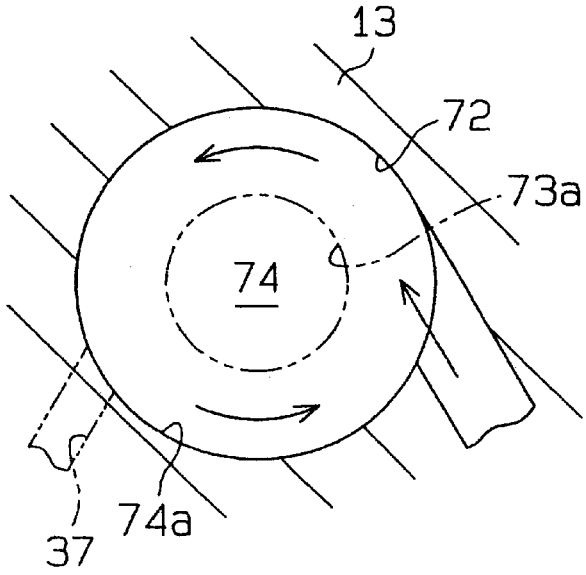

As shown in FIG. 11(*a*), an accommodating chamber 72 is formed in the rear housing member 13. A partition 73 is securely fitted in the accommodating chamber 72 to form an oil chamber 74. The oil chamber 74 forms part of a discharge line that connects the discharge chamber 32 to the external refrigerant circuit. An outlet passage 73*a* is formed in the middle of the partition member 73 to connect the oil chamber 74 to the external refrigerant circuit. Further, a high-pressure side of the supply passage 37 is connected to the oil chamber 74.

When flowing from the discharge chamber 32 to the external refrigerant circuit, refrigerant gas passes through the oil chamber 74. The refrigerant gas, as indicated by the arrows of FIG. 11(*b*), rotates along (as guided by) a cylindrical inner side 74*a* of the oil chamber 74. That is, the oil chamber 74 functions as a rotary chamber that rotates the refrigerant gas. Lubricant oil is thus separated from the refrigerant gas by centrifugal force. Afterwards, the refrigerant gas is discharged to the external refrigerant circuit through the outlet passage 73*a* of the partition member 73. On the other hand, the lubricant oil flows from the oil chamber 74 to the crank chamber 15 through the supply passage 37, together with high-pressure refrigerant gas, which is used for controlling the compressor displacement.

As described, the second oil separator 71 rotates refrigerant gas independently from the rotation of the drive shaft 16 and isolates lubricant oil from the refrigerant gas by centrifugal force. Thus, even when the drive shaft 16 rotates at a relatively low speed, the second oil separator 71 optimally isolates lubricant oil from refrigerant gas. That is, the operation of the second oil separator 71 compensates a lowered oil separating effect of the oil separator 39 of FIG. 1, when the drive shaft 16 rotates at a relatively low speed.

The crank chamber 15 is thus sufficiently lubricated regardless of the rotational speed of the drive shaft 15.

The second oil separator 71 is not restricted to the type of FIG. 11, which operates by centrifugal force. That is, the second oil separator 71 may isolate lubricant oil from refrigerant gas by striking the lubricant oil and the refrigerant gas against an object, or may be an inertia separating type. Alternatively, the second oil separator 71 may be shaped like the oil separator 39 of FIG. 1 and be driven by an independent drive source.

In the illustrated embodiment, the oil chamber 40 accommodates the oil separator 39. However, an accommodating chamber separate from the oil chamber 40 may accommodate the oil chamber 39. In this case, the oil separator 39 separates lubricant oil from refrigerant gas in the accommodating chamber. A communication passage then introduces the lubricant oil from the accommodating chamber to the oil chamber 40.

In the illustrated embodiment, the communication passage 40*a* may be canceled. If this is the case, an oil return passage independent from the supply passage 37 returns lubricant oil from the oil chamber 40 to the crank chamber 15. For example, a space between adjacent rollers of the radial bearing 19 may be enlarged to form the oil return passage. Oil thus flows from the oil chamber 40 to the crank chamber 15 through this enlarged space.

In the illustrated embodiment, the communication hole 42 including the inlet 42*a* and the outlet 42*b* may be canceled. If this is the case, the oil chamber 40 is connected to the crank chamber 15 in a different manner than the illustrated embodiment. For example, a space between adjacent rollers of the radial bearing 19 may be enlarged to form a communication passage that connects the oil chamber 40 to the crank chamber 15. In other words, the enlarged space of the radial bearing 19 forms part of the bleed passage 45. Alternatively, a communication passage may be formed in the cylinder block 12 to connect the oil chamber 40 to the crank chamber 15. In this case, the communication passage forms part of the bleed passage 45.

More specifically, in the aforementioned cases, refrigerant gas flows from the crank chamber 15 to the space around the oil separator 39 in the oil chamber 40. Since the oil separator 39 rotates in the oil chamber 40, the refrigerant gas rotates in the space. Lubricant oil is thus isolated from the refrigerant gas. Afterwards, the refrigerant gas flows to the passage 41 through the clearance between the oil separator 39 and the valve plate body 14 and through the grooves 39*b*.

Alternatively, the passage 41 may extend through the valve plate assembly 14 at a position radially outward from the outer circumference of the flange 39*a*. In this case, after lubricant oil is isolated from refrigerant gas in the space around the oil separator 39 in the oil chamber 40, the refrigerant gas flows to the suction chamber 31 without passing through the interior of the oil separator 39.

The rear end of the drive shaft 16 may be formed as, for example, a cylinder like the oil separator 39. In this case, the rear end of the drive shaft 16 functions as the oil separator 39.

The distal (rear) end of the oil separator 39 does not necessarily have to be located close to the communication passage 40*a*.

A communication passage connects the discharge chamber 32 to the oil chamber 40. In this case, high-pressure refrigerant gas flows from the discharge chamber 32 to the oil chamber 40. The pressure in the oil chamber 40 becomes thus higher than the pressure in the crank chamber 15.

In the illustrated embodiment, the oil separator 39 is formed from a steel plate through pressing. However, the oil separator 39 may be formed through cutting (for example, as a cylinder with a thickened wall).

In the illustrated embodiment, the control valve 38 is located in the supply passage 37 to control the amount of the refrigerant gas that flows from the discharge chamber 32 to the crank chamber 15. However, the control valve 38 may be located in the bleed passage 45 to control the amount of the refrigerant gas that flows from the crank chamber 15 to the suction chamber 31. If this is the case, a fixed restrictor is located between a portion of the supply passage 37 connected to the communication passage 40*a* and the discharge chamber 32.

The entire oil separator 39, including the portion fitted around the drive shaft 16, may be shaped as a straight pipe. That is, the inner diameter of the oil separator 39 is uniform from the proximal end to the distal end.

The oil separator 39 does not necessarily have to include the grooves 39*b*. More specifically, since the distal end of the oil separator 39 does not constantly contact the valve plate assembly 14, lubricant oil still flows from the interior of the oil separator 39 to the exterior even if the oil separator 39 does not have any groove 39*b*.

The oil separator 39 does not necessarily have to include the flange 39*a*.

The oil separators 39, 50 may be shaped as a rectangular parallelepiped.

The fins that rotate in the oil chamber 40 may be directly secured to the drive shaft 16. In other words, a rotary member may be located separately from the oil separators 39, 50.

The movement of the drive shaft 16 may be restricted by a component other than the oil separator 39. For example, an urging spring may urge the drive shaft 16 axially forward.

The rearward movement of the drive shaft 16 may be restricted by abutment between the oil separator 39 and a portion other than the valve plate assembly 14. That is, the rearward movement restrictor may be located in the oil chamber 40 at a position between the oil separator 39 and the valve plate assembly 14. Alternatively, a portion of the cylinder block 12 may project into the oil chamber 40 such that the oil separator 39 directly abuts against the projection.

The oil separator 39 may abut against the main plate 14*a*, instead of the suction valve plate 14*b*, to restrict the rearward movement of the drive shaft 16.

An anti-abrasion coating may be applied on the surface of the oil separator 39 and the surface of the suction valve plate 14*b*. This suppresses abrasive wear of the oil separator 39 and the suction valve plate 14*b*.

The present invention may be applied to a wobble type variable displacement compressor.

Although the present invention is applied to the reciprocating piston type compressor in the illustrated embodiment, the invention may be applied to a rotary type variable displacement compressor such as a scroll type, as described in Japanese Unexamined Patent Publication No. 11-324930.

The present examples and embodiments are to be considered as illustrative and not restrictive and the invention is not to be limited to the details given herein, but may be modified within the scope and equivalence of the appended claims.

What is claimed is:

1. A variable displacement compressor for compressing refrigerant gas that contains lubricant, wherein the compressor compresses the refrigerant gas supplied from a suction chamber to a compression chamber and sends the compressed refrigerant gas to a discharge chamber when a drive shaft rotates, wherein the displacement of the compressor varies in accordance with the pressure in a control chamber located in a compressor housing, and wherein the compressor has a supply passage for supplying the refrigerant gas from the discharge chamber to the control chamber and a bleed passage for bleeding the refrigerant gas from the control chamber to the suction chamber, the compressor comprising:

a separator, which is located in the bleed passage, wherein the separator rotates together with the drive shaft to centrifugally separate the lubricant from the refrigerant gas that flows in the bleed passage;

a lubricant chamber, which is formed in the housing, wherein the lubricant chamber receives the separated lubricant, and the pressure in the lubricant chamber is equal to or greater than the pressure in the control chamber; and a return passage, which is formed in the housing, wherein the return passage returns the lubricant from the lubricant chamber to the control chamber.

2. The compressor according to claim 1, wherein a restrictor is located in the supply passage, wherein a communication passage is formed in the housing and connects the lubricant chamber to a section of the supply passage downstream of the restrictor, and wherein the communication passage and a section of the supply passage downstream of the communication passage function as the return passage.

3. The compressor according to claim 2, wherein a control valve is located in the supply passage and functions as the restrictor, and wherein the control valve adjusts the opening size of the supply passage to control the pressure in the control chamber.

4. The compressor according to claim 2, wherein the restrictor is a first restrictor, wherein a second restrictor is located in a section of the supply passage downstream of the first restrictor, and wherein the communication passage connects the lubricant chamber to the second restrictor.

5. The compressor according to claim 1, wherein a rotary member is located in the lubricant chamber, wherein the rotary member rotates together with the drive shaft to increase the pressure in the lubricant chamber.

6. The compressor according to claim 5, wherein the separator functions as the rotary member.

7. The compressor according to claim 6, wherein the separator includes a fin that promotes the increase of the pressure in the lubricant chamber.

8. The compressor according to claim 1, wherein the separator has a cylindrical shape and includes an internal passage that forms part of the bleed passage, wherein the refrigerant gas passes through the internal passage when flowing in the bleed passage.

9. The compressor according to claim 8, wherein a section of the bleed passage is formed in the drive shaft, wherein the refrigerant gas flows from the control chamber to the internal passage of the separator through the section of the bleed passage in the drive shaft.

10. The compressor according to claim 9, wherein the separator includes a first end connected to one end of the drive shaft and a second end opposite to the first end, wherein the second end abuts against the housing to stop the drive shaft from moving further axially, and wherein a communication port is formed at the second end for connecting the internal passage to the exterior of the separator when the second end abuts against the housing.

11. The compressor according to claim 10, wherein the lubricant chamber is formed around the separator, wherein the separator separates the lubricant from the refrigerant gas that passes through the internal passage and sends the separated lubricant to the lubricant chamber through the communication port.

12. The compressor according to claim 8, wherein a radial dimension of the internal passage gradually increases from an upstream end toward a downstream end with respect to the bleed passage.

13. The compressor according to claim 8, wherein the separator includes a fin located in the internal passage.

14. The compressor according to claim 8, wherein the separator is located in the lubricant chamber, and a fin projects from an outer side of the separator.

15. The compressor according to claim 1, wherein the separator is connected to the drive shaft to rotate integrally with the drive shaft, and wherein the separator abuts against the housing to stop the drive shaft from moving further axially.

16. The compressor according to claim 1, wherein a crank mechanism is located in the control chamber and enables the rotation of the drive shaft to compress the refrigerant gas in the compression chamber.

17. The compressor according to claim 1, wherein the separator is a first separator, and the compressor further includes a second separator that separates the lubricant from the refrigerant gas independently from the rotation of the drive shaft.

18. The compressor according to claim 17 further comprising a discharge line, wherein the discharge line is connected to the discharge chamber for discharging the refrigerant gas from the discharge chamber, and the second separator is located in the discharge line.

19. The compressor according to claim 18, wherein the supply passage is connected to the discharge chamber through the second separator, wherein, after the second separator separates the lubricant from the refrigerant gas, the lubricant flows to the control chamber through the supply passage.

20. The compressor according to claim 17, wherein the second separator includes a rotary chamber that rotates the refrigerant gas to centrifugally separate the lubricant from the refrigerant gas.

* * * * *